United States Patent [19]

Mazza

[11] 3,938,491

[45] Feb. 17, 1976

[54] SWITCHING CIRCUIT FOR IGNITION SYSTEM

[75] Inventor: Benito Marcel Mazza, Ville St. Laurent, Canada

[73] Assignee: Terry Industries, Pointe Claire, Canada

[22] Filed: Apr. 29, 1974

[21] Appl. No.: 464,904

[52] U.S. Cl. ..... 123/149 C; 123/148 E; 123/149 D; 315/209 T; 315/218

[51] Int. Cl.[2] ..... F02P 1/02

[58] Field of Search ..... 123/148 E, 149 C, 149 D, 123/149 R; 315/218, 209 T

[56] References Cited

UNITED STATES PATENTS

| | | | |
|---|---|---|---|
| 3,087,001 | 4/1963 | Short et al. | 123/148 E |
| 3,087,090 | 4/1963 | Konopa | 123/148 E X |
| 3,237,620 | 3/1966 | Hetzler et al. | 123/148 E |
| 3,297,009 | 1/1967 | Sasaki et al. | 123/148 E |
| 3,473,061 | 10/1969 | Soehner et al. | 123/148 E X |
| 3,504,373 | 3/1970 | Strelow | 123/148 E X |
| 3,665,903 | 5/1972 | Harris et al. | 123/148 E X |
| 3,795,826 | 3/1974 | Adey | 123/148 E X |
| 3,841,288 | 10/1974 | Korteling | 123/148 E |

*Primary Examiner*—Wendell E. Burns
*Assistant Examiner*—Tony Argenbright
*Attorney, Agent, or Firm*—Alan Swabey and Company

[57] ABSTRACT

The invention relates to a breakerless ignition system with a magneto supply for use in an internal combustion engine. The system includes a transistorized circuit for interrupting the current flow in the primary winding of the coil to thereby produce the firing voltage in the secondary which is connected to the spark plug. The circuit includes either a single transistor, or two transistors in a Darlington arrangement, connected in series in the circuit of the primary winding. A switching transistor is connected to the control electrode of either the first transistor or the Darlington pair to be adaptable to turn it off. A first resistor has one end connected to the base of the switching transistor. A parallel resistor-capacitor combination is connected in series with a further resistor, and the serial combination is connected in parallel with the Darlington arrangement or the single transistor. The junction of the further resistor and the parallel combination is connected to the other end of the first resistor. The circuit is arranged so that the first transistor, or the Darlington pair, is biased on at the start of a cycle and the switching transistor is non-conductive. The capacitor charges up, through the parallel and further resistors, to turn the switching transistor on, which in turn turns off the first transistor, or Darlington pair. The time interval elapsed before the switching transistor turns on is dependent on a first time constant formed by the parallel and further resistors and the capacitor. The capacitor then discharges through the first resistor and the base-emitter path of the switching transistor until the voltage of the capacitor reaches a predetermined value at which the switching transistor is turned off. The second time interval is dependent on a second time constant formed by the first resistor, the resistance of the base-emitter path of the switching transistor, and the capacitor.

7 Claims, 2 Drawing Figures

SWITCHING CIRCUIT FOR IGNITION SYSTEM

BACKGROUND OF THE INVENTION

1. Field of the Invention

This invention relates to a breakerless ignition system with a magneto supply for use in internal combustion engines. More specifically, this invention relates to such an ignition system wherein, as the speed of the engine is increased, the ignition voltage is increased.

2. Description of the Prior Art

It is known to use transistorized ignition circuits as shown in, for example, U.S. Pat. Nos. 3,034,018, Rosenberg, 3,297,009, Toshiyuki Saski et al, 3,581,725, Hemphill, 3,584,613, Krell, 3,696,257, Shano, and 3,724,974 Kissel. All of the ignition systems as taught in these patents, obtain power from a DC source such as a battery.

It is also known to use ignition systems with a magneto supply instead of the battery. Such ignition systems would be used with smaller engines such as engines which drive chain saws, lawn mowers, snow blowers, etc. It would be advantageous to have an ignition system which provides higher firing voltages at higher speeds in such engines.

An ignition system using a magneto power supply is illustrated in U.S. Pat. No. 3,504,373, Strelow. However, the circuit used by Strelow is expensive in that it uses expensive Zener diodes. It is also a complex circuit in that it requires a large number of components, and it is bulky and of relatively large size for the same reason. In addition, the circuit design of Strelow is different from the circuit design of the instant application.

SUMMARY OF THE INVENTION

The above mentioned, and other disadvantages are overcome with the circuit of the instant invention which provides a high firing voltage at high engine speeds with a simple, inexpensive circuit of solid state construction.

In accordance with the invention, an ignition system for internal combustion engines comprises: spark plug means to be fired by said ignition system; ignition coil means having a primary winding and a secondary winding; said secondary winding being connected to said spark plug means; magnetic means linked magnetically with said ignition coil means and coupled to said engine so as to be moved relative to said ignition coil means and to thereby induce a voltage and current in said primary winding; first controlled electronic switching means having a controlled electrode for controlling the current flow through the switching path of said switching means, said switching path interrupting the circuit of said primary winding; second controlled electronic switching means having a controlled electrode for controlling current flow through the switching path of said second switching means; the switching path of said second controlled electronic switching means being connected to the controlled electrode of said first controlled electronic switching means; said second controlled electronic switching means comprising a conduction path between said controlled electrode of said second controlled electronic switching means and one side of the switching path of said second controlled electronic switching means; a first resistor connected, at one end thereof, to said controlled electrode of said second controlled electronic switching means; a second resistor and a capacitor, connected in parallel arrangement between the other end of said first resistor and said one side of the switching path of said second controlled electronic switching means; and a third resistor connected between the other end of said first resistor and a ground point; whereby, said first controlled electronic switching means will be biased into conduction at the onset by said induced voltage, and the second controlled electronic switching means will be non-conductive; and said capacitor will be charged by said induced voltage through said third and second resistors to bias said second controlled electronic switching means on after a first time interval which is dependent on the time constant formed by said third resistor, said second resistor and said capacitor, the change in state of said second controlled electronic switching means when it is turned on causing said first controlled electronic switching means to be turned off; said capacitor being discharged, when said second controlled electronic switching means is turned on, through said first resistor and said conduction path of said second controlled electronic switching means, so that the voltage of said capacitor drops to a level such that said second controlled electronic switching means is no longer conductive, whereby said second controlled electronic switching means is turned off, after a second time interval which is dependent on the time constant formed by the first resistor, the resistance of the conduction path of the second controlled electronic switching means and the capacitor, the first controlled electronic switching means being no longer turned off when the second controlled electronic switching means is turned off.

BRIEF DESCRIPTION OF THE DRAWING

The invention will be better understood by referring to the following description, together with the accompanying drawings in which.

DETAILED DESCRIPTION OF THE DRAWING

Figure 1:
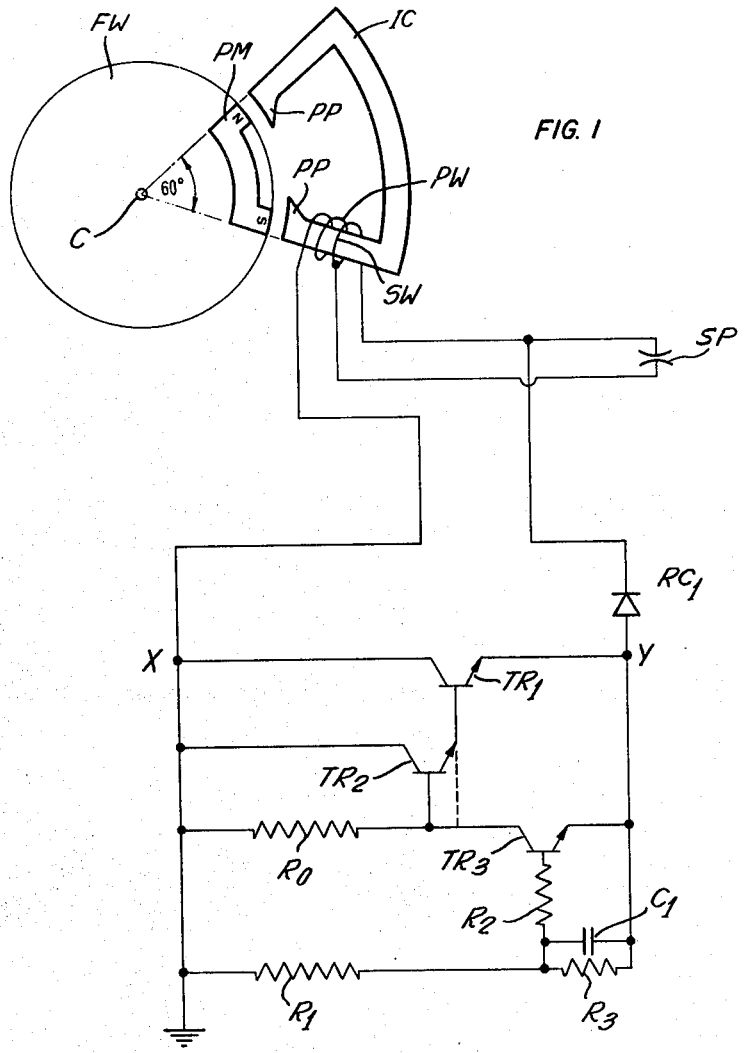
FIG. 1 illustrates two alternate circuit arrangements for carrying out the invention.

Referring to the drawing, the magneto system is schematically illustrated as consisting of a permanent magnet PM mounted on a flywheel FW, which flywheel rotates about its center C with, for example, the crankshaft of the engine. As can be seen, the magnet occupies only some 60° of the total circumference of the flywheel. The magnet passes adjacent pole pieces PP in the ignition coil IC. Primary winding PW and secondary winding SW are wound on the ignition coil, and the output of the secondary winding is connected across a spark plug SP. The primary winding is connected to a further circuit arrangement described below.

Figure 2:
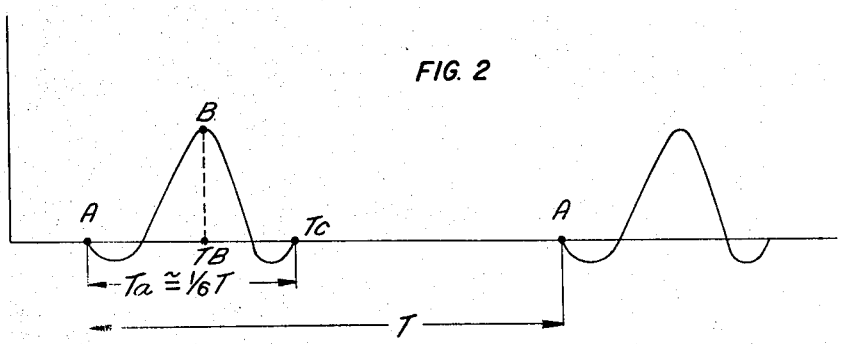
FIG. 2 is an illustration of a graph useful in explaining the invention.

As is well known, the movement of the permanent magnet adjacent the pole pieces will induce a current or voltage in the primary winding of the form shown in FIG. 2, and the current or voltage will be transformed, in a ratio corresponding to the turns ratio of the windings of the ignition coil and carried by the secondary winding.

Referring to FIG. 2, it will be appreciated that this is the form of voltage or current which would exist if the circuit were not interrupted. T*a* is the time during which the permanent magnet is passing adjacent the pole pieces. T is the time for a complete revolution of the flywheel. Point A is, for convenience, designated the beginning of a cycle.

Referring again to FIG. 1, transistors TR1 and TR2 are connected, in a Darlington configuration, in series in the primary winding circuit. Transistor TR3 controls the state of the Darlington pair to switch it out of conduction under predetermined conditions. Resistors R1 and R3, together with capacitor C1, provide a time delay to determine the switch-on time of TR3 and to insure that TR3 is never turned on before TR1 and TR2, and resistor R2, capacitor C1 and the base-emitter path of TR3 provide a time constant which determines the length of time that TR3 remains turned on, as will be discussed below.

It will be appreciated that transistors TR1 and TR2 must be high voltage transistors because of the high voltages developed across them. A Darlington connection is preferred to provide high current complication.

Resistor R0 is a biasing resistor, and diode RC1 is provided to protect the transistors.

In operation, the circuit works as follows:

Because of the biasing arrangements, the voltage induced in the primary winding substantially at the beginning of a cycle will place a more positive potential at the base of TR2 than at its emitter, so that TR2, and thereby TR1, will be turned on (conductive). On the other hand, TR3 will be nonconductive because the potential at its base is not positive enough to turn the transistor on.

With the Darlington pair turned on, the circuit of the primary winding is complete and current will flow through the primary winding. Because of the internal resistance of TR1 and TR2, a potential is developed between points X and Y, and capacitor C1 is charged by this potential so that the potential at the base of TR3 is increasing in a positive direction. At a time which is a function of the time constant formed by R1, R3 and C1, the potential at the base of TR3 will be positive enough to turn TR3 on. This will preferably happen at time substantially T*b* in FIG. 2. When this happens, the Darlington pair will be turned off, and the current in the primary winding will be interrupted.

When the current is interrupted, the magnetic field in the primary will collapse, and a very large voltage will be induced in the secondary, and this large voltage will provide the firing power for the spark plug.

With the transistor TR3 turned on, the capacitor C1 will discharge through the resistor R2 and the base-emitter path of the transistor TR3. The time extent of the firing voltage is a function of the time constant formed by the elements C1, R2, and the resistance of the base-emitter path of TR3. When the voltage at the base of TR3 drops to a predetermined value, the transistor TR3 will be turned off so that the Darlington pair is no longer held off. The Darlington pair can now be turned on again at the start of the next cycle. TR3 will not turn off till or after time T*c* in FIG. 2 because of the second time constant.

The magnitude of the firing voltage is a function of the current which flowed in the primary before the primary path was interrupted. As is well known, the magnitude of this current will increase with the increasing speed of the permanent magnet through the coil IC. Thus, with the instant circuit, as the speed of the engine increases, there will be a propensity for the firing voltage to increase. This propensity is coupled with the time constant R1, R3, C1 to insure that TR3 will be turned on when current in the primary winding is at substantially a maximum. It will, of course, be appreciated that current through the primary in the present ignition system will rise and fall as the permanent magnet passes through the arms of the coil.

It is noted that, when the transistor TR3 is turned off, it cannot be immediately turned on again because of the time constant formed by the elements R1, R3, C1. Thus TR3 cannot be turned on again before the Darlington pair has been turned on.

It will be obvious that the Darlington pair could be replaced by a single transistor. In this case, the dotted line extending from the base terminal would replace the transistor TR2. In addition, it would be possible to use PNP transistors instead of the NPN transistor shown with appropriate circuit modifications.

Although only one embodiment was described, this was for the purpose of illustrating, but not limiting, the invention. Various modifications, which will come readily to the mind of one skilled in the art, are within the scope of the invention as defined in the appended claims.

I claim:

1. An ignition system for internal combustion engines comprising:

a. sparking means for firing in response to said ignition system;

b. ignition coil means for generating a high voltage, said ignition coil having a primary winding and a secondary winding, said secondary winding being connected to said sparking means;

c. magnetic means for linking magnetically with said ignition coil means, said magnetic means being adapted to be moved relative to said ignition coil means and thereby to induce a voltage and current in said primary winding;

d. a first controlled electronic switching means having a controlled electrode for controlling current flow through a first switching path of said first switching means, said first switching path being in the circuit of said primary winding;

e. a second controlled electronic switching means having a controlled electrode for controlling current flow through a second switching path of said second switching means, said second switching path being connected to the controlled electrode of said first controlled electronic switching means;

f. a conduction path through said second switching means between said controlled electrode of said second controlled electronic switching means and one side of said second switching path;

g. a first resistor, having two terminals, connected, at one terminal thereof, to said controlled electrode of said second controlled electronic switching means;

h. a second resistor and a capacitor, connected in parallel arrangement between a second terminal of said first resistor and said one side of said second switching path; and i. a third resistor connected between said second terminal of said first resistor and a ground point;

whereby, said first controlled electronic switching means will be biased into conduction at the onset by said induced voltage, and the second controlled electronic switching means will be non-conductive;

and said capacitor will be charged by said induced voltage through said third and second resistors to bias said second controlled electronic switching means on after a first time interval which is dependent on the time constant formed by said third resistor, said second resistor and said capacitor, the change in state of said second controlled electronic switching means when it is turned on causing said first controlled electronic switching means to be turned off;

said capacitor being discharged, when said second controlled electronic switching means is turned on, through said first resistor and said conduction path of said second controlled electronic switching means, so that the voltage of said capacitor drops to a level such that said second controlled electronic switching means is no longer conductive, whereby said second controlled electronic switching means is turned off, after a second time interval which is dependent on the time constant formed by the first resistor, the resistance of the conduction path of the second controlled electronic switching means and the capacitor, the first controlled electronic switching means being no longer turned off when the second controlled electronic switching means is turned off.

2. An ignition system as defined in claim 1 wherein:

a. said first and second controlled electronic switching means comprise first and second transistors respectively, having base, emitter and collector electrodes;

b. said first and second switching paths of said first and second transistors, comprise paths between the emitter and collector electrodes of the first and second transistors respectively;

c. the conduction path of said second transistor comprises a path between the base and emitter electrodes of said second transistor; and d. the collector electrode of said second transistor is connected to the base electrode of the first transistor.

3. An ignition system as defined in claim 2 wherein said first resistor is connected to the emitter electrode of said second transistor;

and wherein the second resistor and capacitor are connected in parallel arrangement between the second terminal of the first resistor and the emitter electrode of the second transistor.

4. An ignition system as defined in claim 3 and further comprising a third transistor having base, collector and emitter electrodes, said third transistor being connected in a Darlington arrangement with said first transistor whereby the collector electrode of said first transistor is connected to the collector electrode of said third transistor, and the base electrode of said first transistor is connected to the emitter electrode of the third transistor;

the base electrode of said third transistor being connected to the collector electrode of said second transistor.

5. An ignition system as defined in claim 4 wherein each of said first, second and third transistors comprise NPN transistors.

6. An ignition system as defined in claim 5 and further comprising diode means, having an anode electrode and a cathode electrode, in the circuit of said primary winding, the anode electrode of said diode being connected to the emitter electrode of said first transistor.

7. An ignition system as defined in claim 2 further comprising a fourth resistor connected between the collector of said second transistor and ground, whereby proper biasing is established causing said first transistor to be on and said second transistor to be off at the onset of said induced voltage.

* * * * *